United States Patent [19]

Hills et al.

[11] 4,134,515

[45] Jan. 16, 1979

[54] EMERGENCY ROOF DRAIN FOR FLOATING ROOF STORAGE TANKS

[75] Inventors: Richard E. Hills, Coraopolis; Derek K. Neely, Pittsburgh, both of Pa.

[73] Assignee: Pittsburgh-Des Moines Steel Company, Pittsburgh, Pa.

[21] Appl. No.: 847,577

[22] Filed: Nov. 1, 1977

[51] Int. Cl.[2] ..... B65D 51/16; B65D 87/18

[52] U.S. Cl. ..... 220/219; 220/202

[58] Field of Search ..... 220/219, 216, 227, 367, 220/202

[56] References Cited

U.S. PATENT DOCUMENTS

| | | | |
|---|---|---|---|
| 1,979,272 | 11/1934 | Kramer | 220/219 |
| 2,563,017 | 8/1951 | Feild | 220/219 |
| 3,883,032 | 5/1975 | Fisher | 220/219 |

*Primary Examiner*—William Price
*Assistant Examiner*—Steven M. Pollard
*Attorney, Agent, or Firm*—Shoemaker and Mattare, Ltd.

[57] ABSTRACT

An emergency roof drain for floating roof storage tanks includes a siphon carried by the roof with an intake end above the roof and an outlet end below the roof. The siphon is normally closed by a valve and a valve operator is connected to open the valve in response to a predetermined emergency water level on top of the floating roof to thereby siphon the water from the roof and thus prevent sinking of the roof.

19 Claims, 10 Drawing Figures

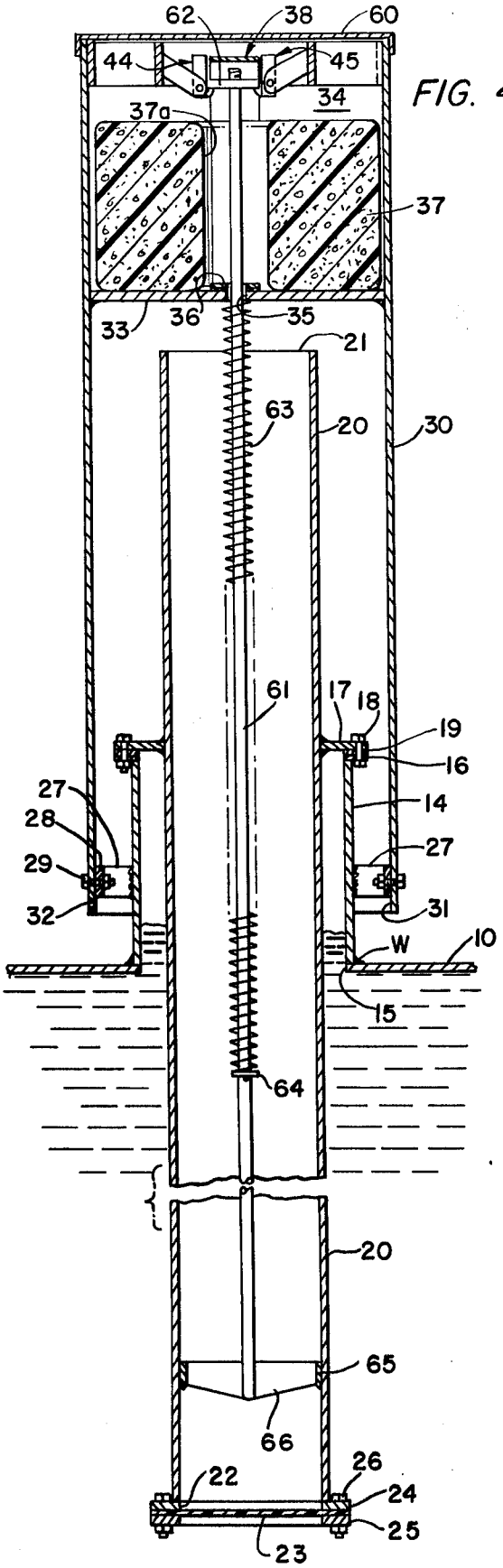
FIG. 4.
FIG. 5.
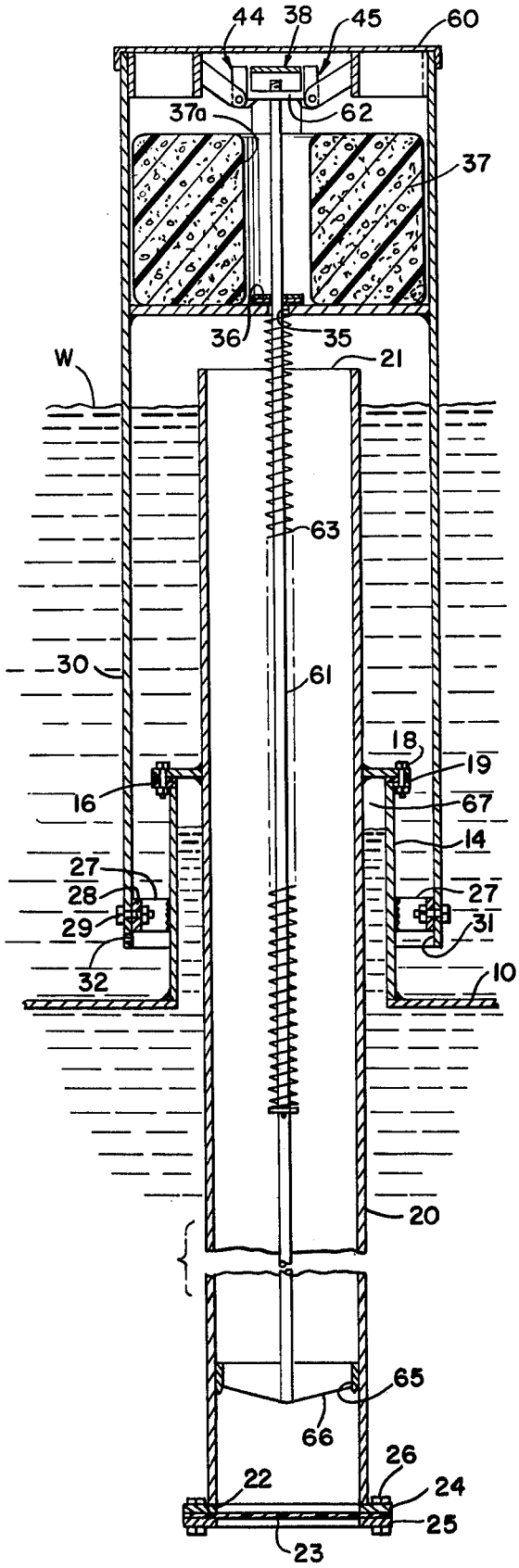

EMERGENCY ROOF DRAIN FOR FLOATING ROOF STORAGE TANKS

BACKGROUND OF THE INVENTION

This invention relates generally to floating roof storage tanks, wherein the roof for the tank floats on the product stored therein. These floating roofs are provided with seal means at their peripheries to effect a seal between the roof and adjacent tank wall as the roof rises and falls with the level of product stored in the tank. While a floating roof is desirable from many standpoints, it does possess disadvantages. For example, water from rain or snow and the like can collect on top of the floating roof and if the water accumulates to a certain level, it may cause the roof to sink or cause structural damage to the roof. Usually, such floating roofs provide a drain connection with a normally closed valve, whereby the valve may be manually opened to drain excess water from the surface of the roof and thereby prevent sinking or damage to the roof. Under most circumstances, such an arrangement is generally satisfactory, since the accumulation of water on the roof may be observed, and when it reaches a dangerous level, an operator simply opens the valve to permit draining of excess water from the surface of the roof. However, an occasion may arise wherein the level accumulates very rapidly due to a severe storm or the like, and an operator may not have an opportunity to open the valve to drain the water from the surface of the roof, with the result that the roof will sink or be structurally damaged. On the other hand, even in the absence of a severe storm or the like, an operator may simply forget to open the valve to drain the water from the roof, and thus serious damage can result. A typical roof drain of the type which requires manual operation is disclosed in U.S. Pat. No. 2,563,017 to A. S. Field.

Another type of roof drain is disclosed in U.S. Pat. No. 3,606,071 to R. B. Wagoner, et al. and in this patent the roof drain comprises a siphon member which becomes operative only when the roof has sunk in the fluid and is resting on the bottom of the tank. Then, as the product stored in the tank is withdrawn, the siphon become effective to siphon liquid off the top of the floating roof.

The present invention is designed for use with a conventional drain valve, such as shown in U.S. Pat. No. 2,563,017, for example, wherein normal collections of water on the surface of the roof may be removed by opening a manually operated drain valve. However, if an operator should forget to open the manual drain valve, or if a severe storm results in a rapid accumulation of an excess amount of water on the surface of the roof, then the emergency drain valve of the present invention becomes operative to drain the water from the roof.

More particularly, the drain valve of the present invention operates on the siphon principle and ramains closed and does not effect draining of water from the roof until the level of the water reaches a predetermined maximum depth. Thereafter, the siphon drain of the present invention becomes operative to drain the water from the roof down to a predetermined minimum level. The operation of the drain valve of the present invention is completely automatic, and does not require operator intervention to render it operative. Moreover, the drain valve of the invention is structured such that there is no danger of the stored product being accidentally leaked or drained from the tank through the water drain valve.

OBJECTS OF THE INVENTION

Thus, it is an object of the present invention to provide an emergency drain valve for draining excess water from the surface of a floating roof in a storage tank, wherein the drain valve operates automatically to drain the water after the level of the water reaches a predetermined depth on the roof, whereby sinking or structural damage of the roof is avoided.

Another object of the invention is to provide an emergency roof drain for floating roof storage tanks wherein the roof drain operates on the siphon principle and is normally inoperative or closed to flow therethrough, but which automatically opens to siphon water from the surface of the floating roof when the level of water on the roof reaches a predetermined depth.

A further object of the invention is to provide an emergency roof drain for floating roof storage tanks wherein the roof drain is normally inoperative but is operative to drain water from the surface of the floating roof when the level of water reaches a predetermined depth either through gradual accumulation over a prolonged period of time or rapid accumulation as from a severe storm or the like.

Yet another object of the invention is to provide a simple and economical emergency roof drain for floating roof storage tanks which is reliable in operation and which is constructed such that the stored product will not reverse flow through the emergency drain.

BRIEF DESCRIPTION OF THE DRAWINGS

FIG. 4 is a greatly enlarged, fragmentary view in vertical section, with portions broken away, of the emergency drain valve of the invention on a floating roof in a dry condition.

FIG. 5 is a view similar to FIG. 4 of the emergency drain valve of the invention on a floating roof with water accumulated thereon to a level below or less than an emergency level.

DETAILED DESCRIPTION OF THE INVENTION

Figure 1:
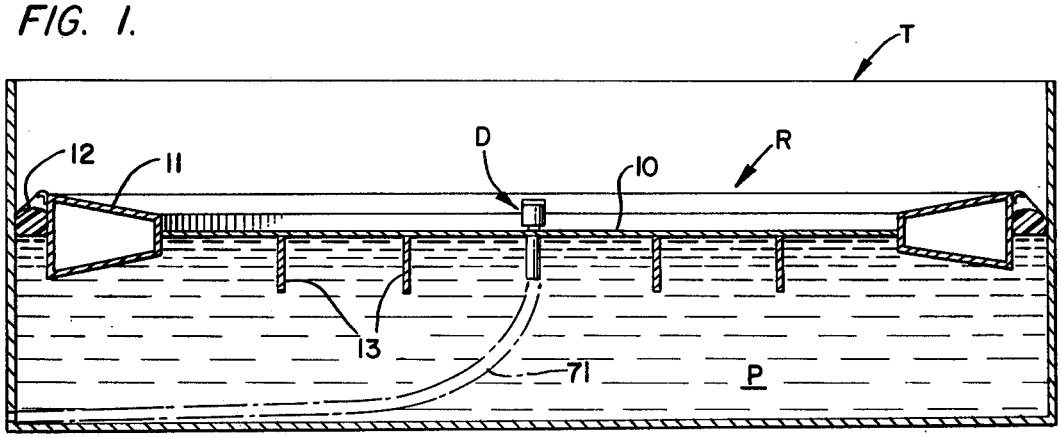
FIG. 1 is a fragmentary, vertical, sectional view, with portions broken away, of a tank having a floating roof with the emergency drain valve of the invention associated therewith.

In the drawings, wherein like reference numerals indicate like parts throughout the several views, a floating roof R is shown floating on a stored product P in a tank T, and an emergency drain D in accordance with the invention is carried by the roof R. The roof R may be of any typical or conventional construction for a floating roof, and as particularly shown and described herein, comprises a single deck 10 having an annular peripheral pontoon 11 with a rim space seal 12 carried thereby and a plurality of support legs 13 on the underside of the deck 10 for engaging the bottom of the tank and supporting the roof when the product is withdrawn from the tank and the roof R is lowered to the bottom of the tank.

Figure 2:
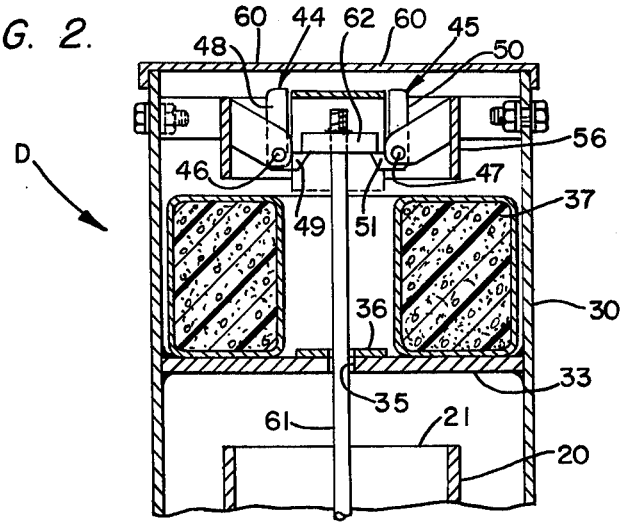
FIG. 2 is an enlarged, fragmentary view in vertical section of the operating and latch means for the valve operator of the emergency drain of the invention.
Figure 3:
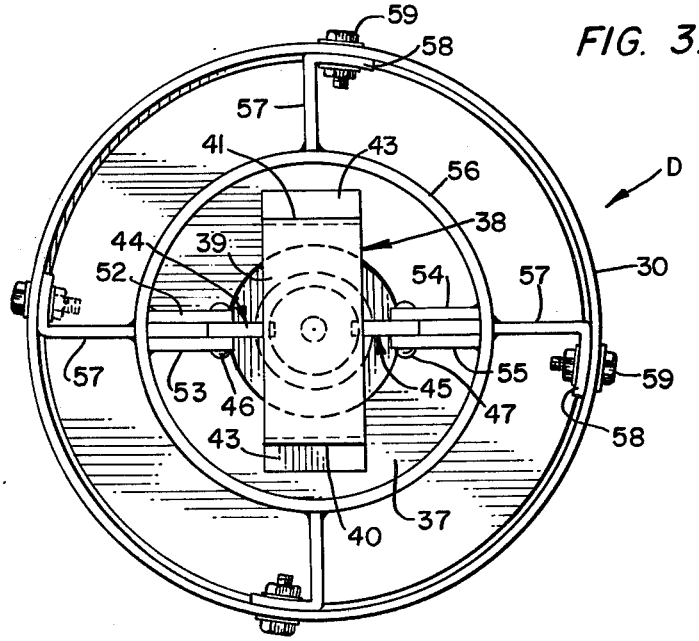
FIG. 3 is a greatly enlarged, plan view of the emergency drain valve of the invention.

The emergency drain D is seen best in FIGS. 2, 3 and 4, and comprises a relatively short, cylindrical mounting stand pipe 14 suitably secured at its lower end, as by a weld or the like W, to the deck 10 in registry with an opening 15 through the deck. An annular, outwardly extending bolting flange 16 is on the upper end of the mounting pipe 14 for bolting a bolting ring 17 to the mounting stand pipe by means of a plurality of bolts 18 extended through the bolting ring and bolting flange. A gasket 19 is engaged between the bolting ring and bolting flange to effect a seal therebetween. The annular bolting ring 17 is welded or otherwise suitably affixed to the outer surface of an elongate, cylindrical, inner siphon tube 20 having an open upper end 21 and an open lower end 22 closed by a frangible membrane or valve member 23. As shown in the preferred form of the invention, the sealing valve or membrane 23 is formed of an elastomeric material and is clamped at its periphery between outwardly extending flange 24 on the bottom end of inner siphon tube 20 and a clamping ring 25 bolted to the flange 24 by means of a plurality of bolts or the like 26.

As seen in FIG. 4, the bolting ring 17 is affixed to the inner siphon tube 20 between the ends of the tube, such that the lower end of the tube 20 projects downwardly below the deck 10 approximately 3 feet in one form of the invention. The upper end 21 of the tube may project upwardly above the deck 10 a distance of 30 inches to accommodate a certain amount of sag of the roof as water collects thereon. However, it should be noted that the floating roof is usually designed to store up to 10 inches of uniform rainfall on top of the roof before any drain becomes operative. The bolting ring 17 and bolts 18 permit the inner siphon tube 20 to be unbolted from the mounting pipe 14 and removed from the opening 15 for repair or inspection or the like.

A plurality of radially extending supports 27 are suitably affixed to the outer surface of the mounting pipe 14 between the ends thereof and the supports include bolting flanges 28 extending in a circumferential direction at the outer ends thereof for receiving bolts or the like 29 therethrough to releasably secure an outer siphon tube 30 to the mounting stand pipe 14. The outer siphon tube 30 has an open lower end 31 with an air bleed opening 32 formed radially therethrough adjacent the lower end thereof for a purpose to be later described. a substantially discshaped wall or plate 33 is secured inside the outer siphon tube 30 adjacent the upper end thereof defining the bottom wall for a float chamber 34 at the upper end of the outer siphon tube. The bottom wall 33 has a central opening 35 therethrough for admitting water into the float chamber 34 and also for venting air from the inner and outer siphon tubes as they become filled with liquid. A suitable sealing gasket 36 is on the upper surface of bottom wall 33 of chamber 34 surrounding the opening 35.

A float means 37, shown here as toroidal in shape, is received in float chamber 34 and normally rests on bottom wall 33 of the float chamber. The float 37 carries a substantially U-shaped bracket or trip latch 38 on its upper side with the trip latch extending across the center of the float 37 in spanning relationship to the central opening **37*a* through the float. The trip latch 38 includes a transversely extending web or bight portion 39 and downwardly extending legs 40 and 41 with outturned flanges 42 and 43 resting on the upper surface of the float 37. The web or bight portion 39 of trip latch 38 is normally engaged between the upper ends of a pair of cocking levers 44 and 45 which are generally L-shaped in configuration and are pivoted at 46 and 47, respectively, adjacent the junctures of the vertical and horizontal legs 48, 49 and 50, 51, respectively. The pivots 46 and 47 are carried by respective pairs of brackets 52, 53 and 54, 55 projecting radially inwardly from a support ring 56 and secured as by a weld or the like to the support ring 56. The support ring 56 is in turn supported from a plurality of support brackets 57 having circumferentially extending bolt flanges 58 thereon releasably secured to the outer siphon tube 30 by means of bolts or the like 59 extended through the siphon tube and through the bolt flanges 58 on brackets 57**.

A removable cover 60 is normally disposed over the open upper end of the outer siphon tube 30 to protect the operating components of the emergency drain from the elements.

An elongate cutter drive bar 61 extends coaxially within the inner siphon tube 20 upwardly through air vent opening 35 and through the opening **37*a* of float 37 to adjacent the cocking levers 44 and 45 and has a circular seal plate 62 carried by the upper end thereof normally engaged on and supported by the horizontal legs 49 and 51 of the cocking levers 44 and 45. A spring means 63 surrounds the drive bar 61 and is engaged between the underside of bottom wall 33 of float chamber 34 and a spring stop washer 64 secured to the cutter drive bar between the ends thereof for urging the cutter drive bar 61 downwardly. However, as long as the trip latch 38 is engaged between the upper ends of vertical legs 48 and 50 of cocking levers 44 and 45, the horizontal legs of the cocking levers are engaged beneath the seal plate 62, thus holding the drive bar 61 upwardly against the bias of spring means 63. An annular cutting ring 65 is carried at the outer ends of spider members 66 on the lower end of cutter drive bar 61 and the cutter ring 65 is disposed in close proximity to the inner surface of inner siphon tube 20, whereby when the float 37 is elevated to remove the trip latch 38 from between the cocking levers 44 and 45, the cutter drive bar is forced sharply downwardly by the spring means 63 and the cutting ring 65 fractures or severs the membrane or valve 23**.

As viewed in FIG. 4, there is no liquid on top of the deck 10 and the cutter or cutting ring 65 remains in its cocked position retained by the cocking levers 44 and 45 engaged beneath the seal plate 62.

In FIG. 5 a body of water W has collected on top of the deck 10 to a level slightly below the upper end of inner siphon tube 20. This level of the water is less than that required to operate the emergency drain, and the floating roof is able to support this amount of water without danger of sinking or structural damage thereto. It should be noted that the combined weight of the floating roof and the water W thereon is sufficient to cause the roof or deck to sink partially into the stored product, with the result that the product is forced upwardly into the mounting stand pipe 14 trapping a body of air therein at 67, which compressed, trapped body of air prevents the level of product within stand pipe 14 from rising to any greater degree than that shown in FIG. 5.

Figure 6:
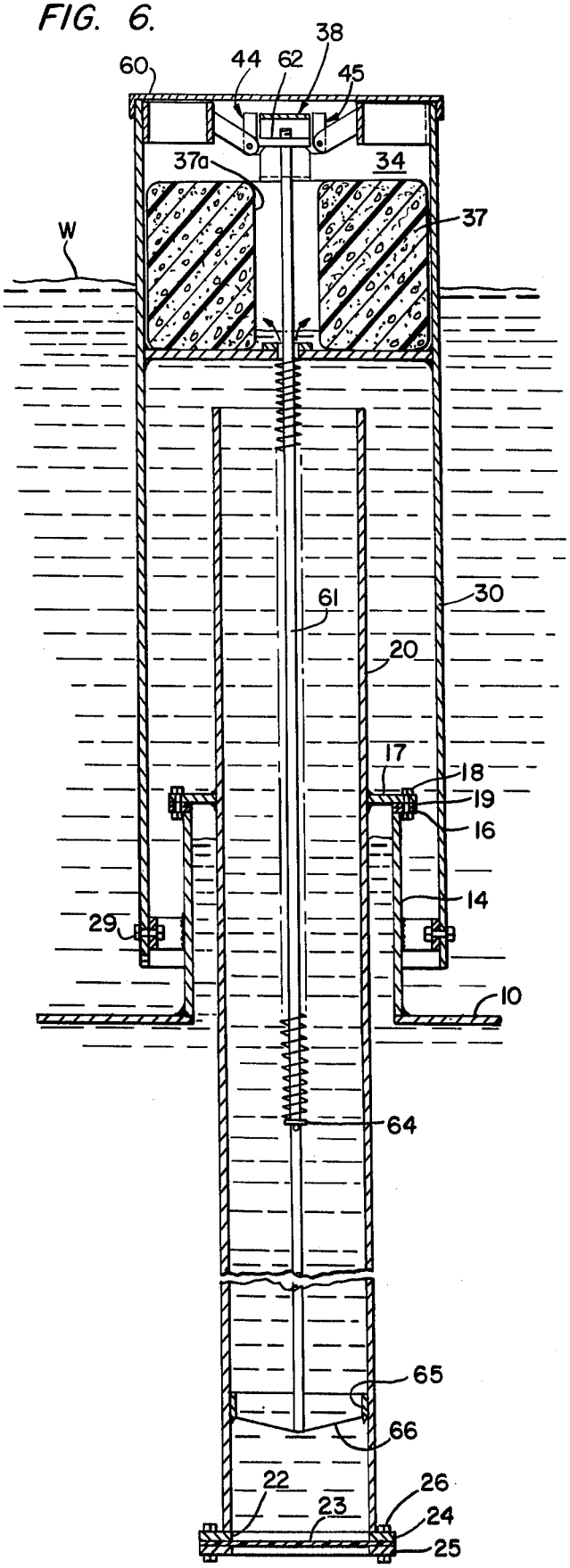
FIG. 6 is a view similar to FIG. 5 with water on the floating roof accumulated to an emergency level, and with opening of the siphon valve imminent.

In FIG. 6 the level of water W on the deck 10 is at the emergency water level, and as can be seen, the inner and outer siphon tubes are filled with the water and water is entering the flow chamber 34, creating a buoyant force on the float 37. It should be noted in connection with this figure that all air which might have been trapped in the siphon tubes 20 and 30 was enabled to escape through the opening 35 in bottom wall 33 of the float chamber 34.

Figure 7:
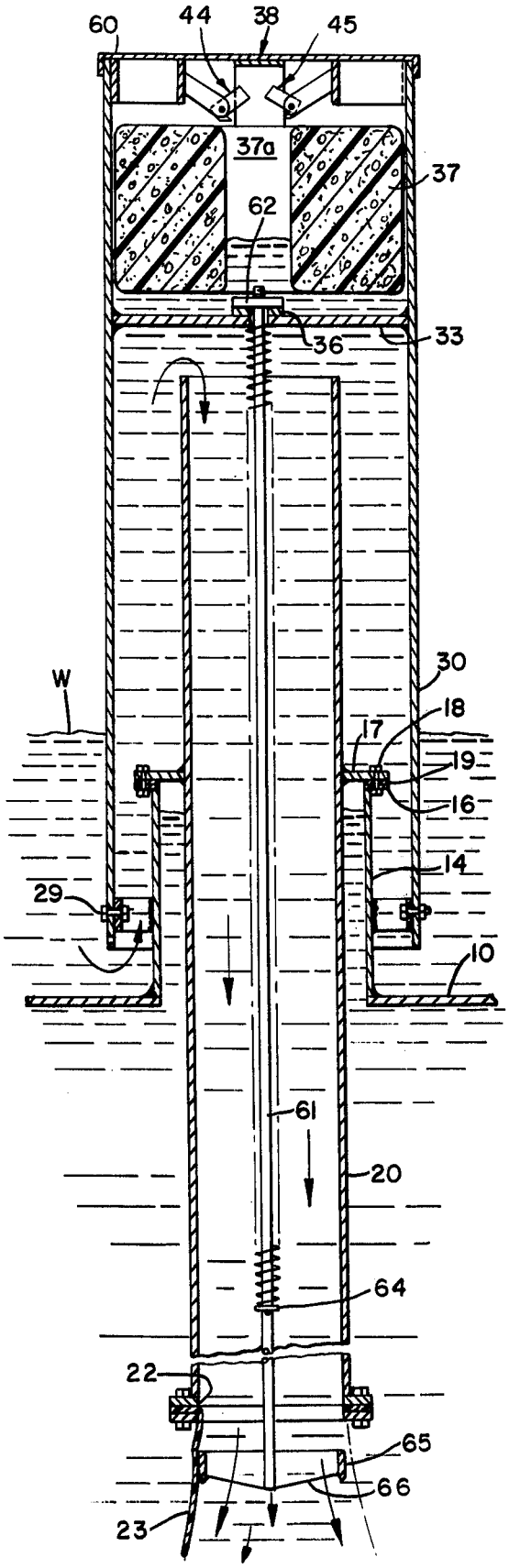
FIG. 7 is a view similar to FIG. 6 with the emergency drain valve opened and with water being siphoned therethrough from the surface of the roof into the stored product.

In FIG. 7 the float has been elevated by the water in float chamber 34, thus removing the trip latch 38 from between the cocking levers 44 and 45 and releasing the seal plate 62, thereby enabling the spring means 63 to drive the cutter drive bar 61 forcefully downward, whereby the cutter or cutting ring 65 fractures the seal 23, opening the lower end of inner siphon tube 20 and permitting the column of water therein to fall downwardly under the influence of gravity into the product stored in the tank. In this connection, it should be noted that the specific gravity of the water is greater than the specific gravity of the product stored in the tank. In fact, to provide a margin of safety, the specific gravity of the product should be less than about 0.95. Thus, as the column of water drops out of the inner siphon tube 20, it in effect forms a pathway or columnar flow area through the stored product P and the weight of the column of water leaving the inner siphon tube 20 creates a low pressure at the top thereof which draws the water in the outer siphon tube upwardly and into the inner siphon tube for flow downwardly into the tank. This siphon action continues until the level of water on top of the deck 10 nears the bottom open end of outer siphon tube 30 as seen in FIG. 8, and the air bleed opening 32 at the bottom end of the outer siphon tube 30 is then effective to gradually break the siphon and the siphon thus is rendered inoperative, whereby the column of water in the inner siphon tube falls freely into the tank and is replaced by product P.

Figure 8:
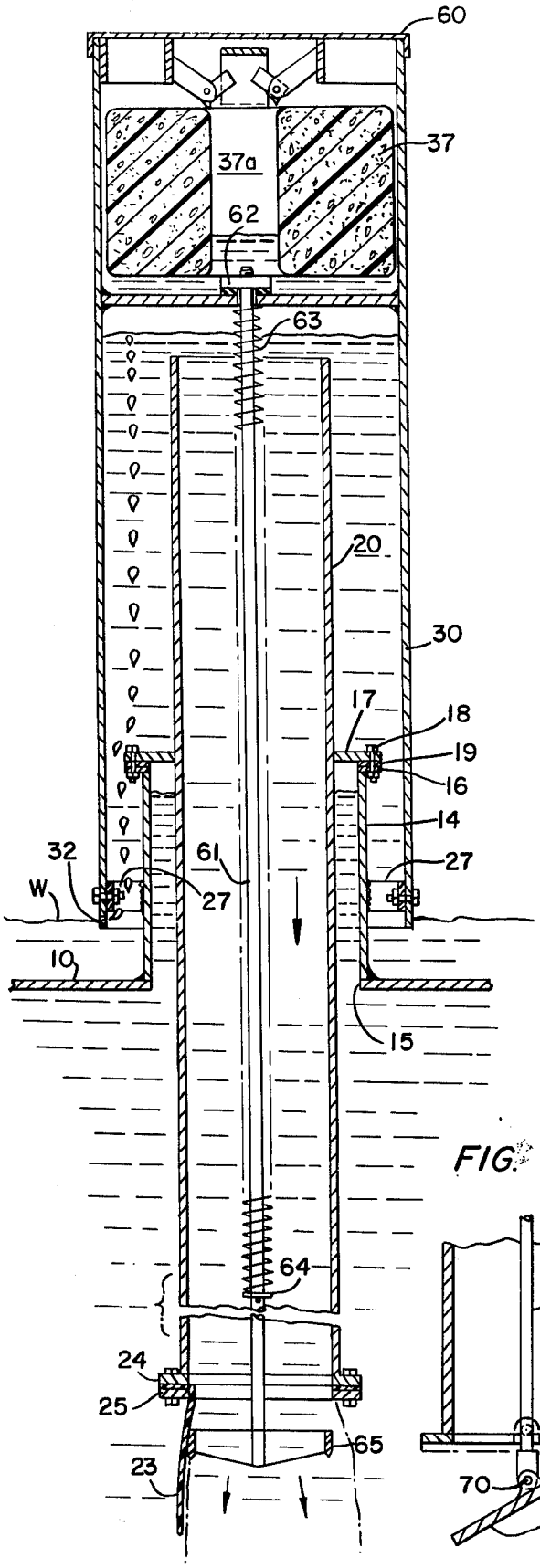
FIG. 8 is a view similar to FIG. 7 with the siphon action being broken by an air bleed hole in one of the siphon tubes, and with flow through the drain valve about to be terminated.
Figure 9:
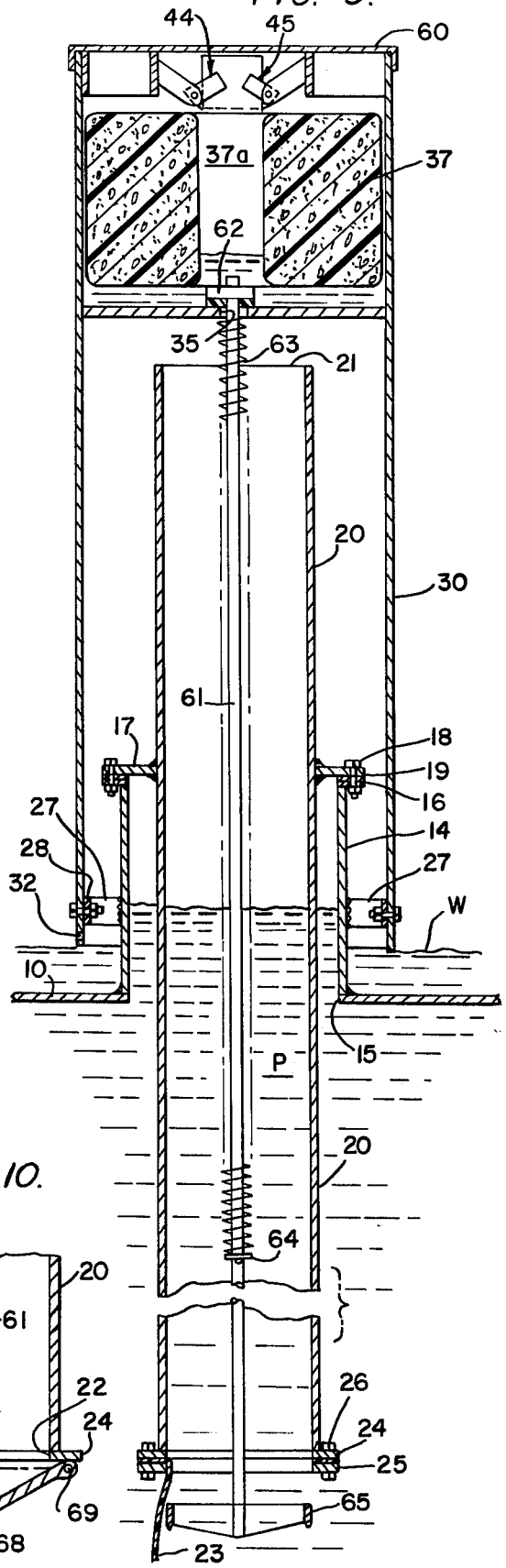
FIG. 9 is a view similar to FIG. 8 of the emergency drain valve in a quiescent state after the water on the surface of the roof has been drained to a predetermined level, and showing the stored product displaced upwardly into the inner siphon tube by the combined weight of the floating roof and the remaining water thereon.

It should be noted in connection with FIGS. 6 and 8, for example, that prior to tripping of the cocking levers 44 and 45, the opening 35 established free communication, whereby air was vented from the siphon tubes and also water was permitted to enter the float chamber. However, after the cocking levers were released for breaking the membrane 23, the seal plate 62 engaged on gasket 36 surrounding the opening 35, thus sealing the opening to ingress of air into the siphon tubes so that the siphon action remained effective until broken by the air bleed opening 32. The water trapped in the float chamber 34 also serves as a seal to assist in preventing ingress of air into the siphon during operation thereof.

Figure 10:
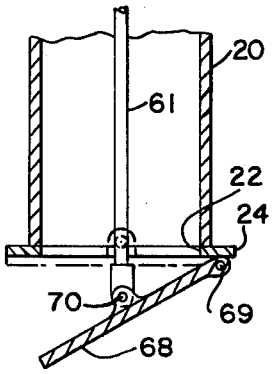
FIG. 10 is a fragmentary view in section of a modified valve for the emergency drain of the invention, wherein the valve is reusable.

A modification of the valve for the emergency drain is shown in FIG. 10 and in this form of the invention, rather than a frangible membrane 23, a reuseable closure plate or valve 68 is pivotally connected at 69 to the bolting flange 24 on the bottom end 22 of inner siphon tube 20 and the cutter drive bar 61 is pivotally connected at 70 to the valve closure plate 68, whereby when the cutter drive bar is released by operation of the float 37, the spring 63 urges it downwardly to pivot the valve plate 68 to an open position and allow escape of water from the siphon tube in the manner described in connection with the first form of the invention.

Further, if desired, and as illustrated in dot-and-dash lines in FIG. 1, a flexible drain hose 71 may be connected with the lower end of the emergency drain D to drain water from the roof directly outside the tank rather than into the stored product.

After the emergency drain of the invention has been used, it is necessary to replace the membrane 23, and this is accomplished by loosening the bolts 29 and removing the outer siphon tube 30. Thereafter, the bolts 18 may be loosened and the inner siphon tube 20 removed. The bolts 26 are then loosened on the lower end of the siphon tube and a new membrane placed thereon, after which the inner and outer siphon tubes are replaced, the cutter drive bar raised to engage the seal plate 62 with the cocking levers 44 and 45, and the invention is again ready for use.

In a specific construction or example of the invention, the float comprises a resin coated urethane foam and the air bleed hole or float chamber fill hole 35 has approximately a 7/16 inch diameter. The inner siphon tube is a 6 inch inside diameter pipe and the cutter drive bar is a ½ inch diameter stainless steel rod.

It should be noted that the trip latch 38 may be secured on the float if desired. Also, the float need not be placed above the siphon as illustrated and described, but may be lower. Further, the spring 63 may be replaced with a weight attached to the rod 61, or the weight of the cutting ring 65 may be increased to provide the required cutting force.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. An emergency roof drain for floating roof storage tank, comprising: a siphon attached to a floating roof for drawing water off of a floating roof, said siphon having an inlet end spaced from and disposed above the upper surface of the roof so that water on the roof moves upwardly from the roof into said siphon through said siphon inlet, and an outlet end disposed within the tank beneath the level of a liquid stored in the tank and spaced from and below the roof; a normally closed valve means in the outlet end of the siphon, said valve means being located beneath the roof and normally closing said outlet end for normally preventing flow through the siphon; and valve opening means located in said siphon to be associated with the valve means to open the valve means in response to a predetermined emergency water level on a roof with which the siphon is used, to thereby siphon water from the roof and thus prevent sinking of the roof.

2. An emergency roof drain for draining water from a floating roof on a storage tank when the water reaches a predetermined depth on the roof, comprising: siphon means carried by the roof and having an inlet end spaced a predetermined distance above the upper surface of the roof so that water on the roof moves upwardly from the roof into said siphon through said siphon inlet, and an outlet end spaced a predetermined distance below the roof to be disposed within the tank beneath the level of a fluid stored in the tank; normally closed valve means in the siphon outlet end for normally preventing flow therethrough; and valve operating means located in said siphon to be associated with the valve means and operative in response to a predetermined depth of water on the roof to open the valve means and enable the siphon means to remove water from the roof by a siphoning action.

3. An emergency roof drain as in claim 2, wherein the siphon means includes means for preventing backflow of product from beneath the roof through the siphon means and onto the roof.

4. An emergency roof drain as in claim 2, wherein the siphon means is readily releasably attached to the roof by a releasable fastening means, whereby the siphon means may be readily removed from the roof for service or repair.

5. An emergency roof drain as in claim 2, wherein the valve operating means comprises a float arranged to be actuated upon occurrence of the predetermined depth of water to open the valve means.

6. An emergency roof drain as in claim 5, wherein the siphon means comprises a first tubular porton extending upwardly from the roof and having the inlet end in the lower end thereof, a second tubular portion extending from below the roof to above the roof and having the siphon outlet in its lower end and being in communication at its upper end with the upper end of the first tubular portion.

7. An emergency roof drain as in claim 6, wherein the valve means is in the lower, outlet end of the second tubular portion.

8. An emergency roof drain as in claim 7, wherein the first and second tubular portions comprise separate tubular members extending generally vertically and being coaxial with one another, said first tubular member having a larger diameter than the second tubular member and the second tubular member extending upwardly therewithin in radially inwardly spaced relationship thereto.

9. An emergency roof drain as in claim 7, wherein the valve means comprises a sealing member extending across the lower end of the second tubular portion, the valve operating means comprises an elongate rod having a first position extending from one end thereof adjacent the float to its other end spaced from the sealing member, and restraining means engaged with said rod to normally hold it in its first position, said float connected to release the restraining means when the depth of water on the roof reaches the predetermined amount, whereby the rod moves to a second position with its said other end engaging the sealing member to open it and release water from the second tubular portion to initiate operation of the siphon.

10. An emergency roof drain as in claim 9, wherein biasing means is engaged with the rod urging it toward its second position.

11. An emergency roof drain as in claim 10, wherein the sealing member comprises a frangible membrane and a cutting member is carried by said other end of the rod to cut the membrane when the rod moves to its second position.

12. An emergency roof drain as in claim 10, wherein the sealing member comprises a pivoted plate and the rod is pivotally connected thereto to open the plate when the rod moves to its second position.

13. An emergency roof drain as in claim 9, wherein the restraining means comprises a trip latch carried by the float and a pair of cocking levers engaged with the trip latch and with said one end of the rod to hold the rod in its first position, said trip latch being movable out of engagement with the cocking levers when the float is elevated upon occurrence of the predetermined depth of water on the roof to thus release the cocking levers from engagement with the one end of the rod and thereby release the rod for movement to its second position.

14. An emergency roof drain as in claim 13, wherein the float is confined within a float chamber at the upper end of the first tubular portion and the float chamber has a bottom wall separating the float chamber from the interior of the siphon means, said wall having an opening therethrough for venting air from the siphon means as water is flowing thereinto to prime it.

15. An emergency roof drain as in claim 14, wherein a seal plate is carried by the rod at its said one end in a position to close the opening when the rod is in its second position to thus prevent breaking of the siphon by air entering the siphon through the opening.

16. An emergency roof drain as in claim 6, wherein the float is confined within a float chamber at the upper end of the first tubular portion.

17. An emergency roof drain as in claim 16, wherein the first and second tubular portions comprise separate tubular members extending generally vertically and being coaxial with one another, said first tubular member having a larger diameter than the second tubular member and the second tubular member extending upwardly therewithin in radially inwardly spaced relationship thereto, said valve means being in the lower, outlet end of the second tubular member.

18. An emergency roof drain as in claim 17, wherein the float chamber has a bottom wall separating the float chamber from the space between the first and second tubular members, said wall having an opening therethrough for venting air from the siphon means as water is flowing thereinto to prime it.

19. An emergency roof drain as in claim 18, wherein air bleed means is in the first tubular member to bleed air into the siphon means and break the siphon after the water level on the roof has fallen below a predetermined level to thereby prevent reverse siphoning of stored product through the siphon means.

* * * * *